US006699806B1

(12) United States Patent
Takeuchi et al.

(10) Patent No.: US 6,699,806 B1
(45) Date of Patent: Mar. 2, 2004

(54) WATER-DECOMPOSABLE FIBROUS SHEET OF HIGH RESISTANCE TO SURFACE FRICTION, AND METHOD FOR PRODUCING IT

(75) Inventors: Naohito Takeuchi, Kagawa (JP); Kazuya Okada, Kagawa (JP); Jyoji Shimizu, Kagawa (JP); Toshiyuki Tanio, Kagawa (JP); Takayoshi Konishi, Kagawa (JP)

(73) Assignee: Uni-Charm Corporation, Kawanoe (JP)

( * ) Notice: Subject to any disclaimer, the term of this patent is extended or adjusted under 35 U.S.C. 154(b) by 420 days.

(21) Appl. No.: 09/627,013

(22) Filed: Jul. 27, 2000

(30) Foreign Application Priority Data

Oct. 6, 1999 (JP) ..... H11-285655
Mar. 31, 2000 (JP) ..... 2000-99437

(51) Int. Cl.[7] ..... D04H 1/00; D04H 13/00; D04H 3/00; B32B 5/26

(52) U.S. Cl. ..... 442/340; 442/344; 442/381; 442/384; 442/385; 442/408

(58) Field of Search ..... 442/340, 344, 442/381, 384, 385, 408

(56) References Cited

U.S. PATENT DOCUMENTS

| | | | | |
|---|---|---|---|---|
| 3,563,241 A | | 2/1971 | Evans | 128/284 |
| 3,785,918 A | | 1/1974 | Kawai et al. | 161/169 |
| 5,292,581 A | * | 3/1994 | Viazmensky et al. | 428/288 |

FOREIGN PATENT DOCUMENTS

| | | |
|---|---|---|
| FR | 1423789 | 3/1966 |
| GB | 687041 | 2/1953 |
| JP | 3-292924 | 12/1991 |
| JP | 6-198778 | 7/1994 |
| JP | 7-24636 | 3/1995 |

* cited by examiner

*Primary Examiner*—Cheryl A. Juska
*Assistant Examiner*—Christopher C. Pratt
(74) *Attorney, Agent, or Firm*—Darby & Darby

(57) ABSTRACT

Provided is a water-decomposable fibrous sheet including fibers containing at least 3% by mass of fibrillated rayon. The fibrillated rayon has a degree of beating of at most 700 cc and has primary fibers of a predetermined fiber length and microfibers extending from the primary fibers. In the fibrous sheet, the microfibers are entangled with at least either of other microfibers and other fibers therein, and the surface friction resistance of the fibrous sheet in dry, measured according to the abrasion resistance test method of JIS P-8136, is at least three rubbing cycles.

9 Claims, 5 Drawing Sheets

WATER-DECOMPOSABLE FIBROUS SHEET OF HIGH RESISTANCE TO SURFACE FRICTION, AND METHOD FOR PRODUCING IT

BACKGROUND OF THE INVENTION

1. Field of the Invention

The present invention relates to a water-decomposable fibrous sheet capable of being readily decomposed and dispersed in water flow. More precisely, it relates to such a water-decomposable fibrous sheet resistant to surface friction.

2. Description of the Related Art

To wipe the skin of human bodies including the private parts thereof, or to clean toilets and thereabouts, used are disposable cleaning sheets made of paper or non-woven fabric. For these cleaning sheets, water-decomposable cleaning sheets that could be directly disposed of in toilets after use have been developed, as being convenient for such purposes. The degree of their decomposability in water must be high in some degree. This is because, if poorly water-decomposable cleaning sheets are disposed of in toilets after use, they will take a lot of time until they are decomposed and dispersed in septic tanks, or will clog the drainpipes around toilets, etc.

For wiping off wet dirt and for easy and effective use, many cleaning sheets for wiper applications are packaged while being wetted with a liquid detergent chemical or the like, and are put on the market. Therefore, such water-decomposable cleaning sheets must have high strength in wet to such a degree that they are well fit for wiping with them wetted with such a liquid chemical or the like, but must well decompose in water after they are disposed of in toilets.

For example, Japanese Patent Publication No. 24636/1995 discloses a water-decomposable cleaning article that comprises a water-soluble binder having a carboxyl group, a metal ion and an organic solvent. However, the metal ion and the organic solvent irritate the skin.

Japanese Patent Laid-open No. 292924/1991 discloses a water-decomposable cleaning article of polyvinyl alcohol-containing fibers with an aqueous solution of boric acid infiltrated thereinto; and Japanese Patent Laid-Open No. 198778/1994 discloses a water-decomposable napkin of polyvinyl alcohol-containing non-woven fabric with a borate ion and a bicarbonate ion introduced thereinto. However, polyvinyl alcohol is not resistant to heat, and therefore the wet strength of the water-decomposable cleaning article and the water-decomdosable napkin is lowered at 40° C. or higher.

Recently, various water-decomposable absorbent articles including sanitary napkins, panty liners, disposable diapers and others have been investigated in the art. In view of their safety, however, the water-decomposable fibrous sheets mentioned above could not be used as the top sheets for those absorbent articles that shall be kept in direct contact with the skin for a long period of time, as they contain a binder and an electrolyte.

On the other hand, Japanese Patent Laid-Open No. 228214/1997 discloses a water-degradable non-woven fabric having a wet strength of from 100 to 800 gf/25 mm (from 0.98 to 7.84 N/25 mm) as measured according to JIS P-8135, which is produced by mixing fibers having a length of from 4 to 20 mm with pulp followed by entangling them through treatment with high-pressure water jets. Since the constituent fibers are entangled in it, the non-woven fabric disclosed has a bulky feel. However, in producing the non-woven fabric, long fibers are entangled through high-pressure water jet treatment, whereby the non-woven fabric produced could have such a relatively high wet strength. Therefore, according to the technique disclosed, it is difficult to realize well-balanced bulkiness, strength and water-degradability for the non-woven fabric produced, and the non-woven fabric produced is unsuitable to disposal in flush toilets, etc.

SUMMARY OF THE INVENTION

An object of the present invention is to provide a water-decomposable fibrous sheet which is well decomposed in water and has good strength enough for practical use even though no binder is added thereto.

Specifically, the invention is to provide a water-decomposable fibrous sheet comprising fibers containing at least 3% by mass of fibrillated rayon, the fibrillated rayon having a degree of beating of at most 700 cc and having primary fibers of a predetermined fiber length and microfibers extending from the primary fibers;

wherein the microfibers are entangled with at least either of other microfibers and other fibers therein, and the surface friction resistance of the fibrous sheet in dry, measured according to the abrasion resistance test method of JIS P-8136, is at least three rubbing cycles.

Naturally in dry and even in wet with water, the water-decomposable fibrous sheet of the invention all the time keeps high strength. When it is immersed in a large amount of water after used and disposed of in toilets and others, it is readily decomposed. In the fibrous sheet of the invention, the microfibers of fibrillated rayon are entangled with and are further hydrogen-bonded to other fibers and other microfibers therein, thereby exhibiting their ability to bond fibers constituting the sheet and to enhance the strength of the sheet. When the fibrous sheet receives a large amount of water applied thereto, the entangled microfibers therein are loosened or the hydrogen bonds between the bonded microfibers therein are broken, whereby the fibrous sheet is readily decomposed in water.

In addition, the surface of the water-decomposable fibrous sheet of the invention is highly resistant to friction. The sheet surface contains many microfibers, and the microfibers therein are principally brought into direct contact with the surfaces of other objects. Accordingly, during use, the overall friction that the fibrous sheet will directly receive will be reduced, and the sheet surface will be hardly broken even when rubbed against other objects and could keep a predetermined strength. Therefore, when the fibrous sheet is used as a wiper sheet or as a top sheet for absorbent articles, it is not broken and gives a comfortable feel to users.

The water-decomposable fibrous sheet of the invention can be composed of materials not harmful to human bodies.

Preferably, the surface friction resistance of the fibrous sheet in wet is at least three rubbing cycles.

Also preferably, the sheet surface is pressed under heat so that the microfibers of the fibrillated rayon therein are hydrogen-bonded to at least either of other microfibers and other fibers therein.

Also preferably, the fibrillated rayon in the fibrous sheet is such that the length of the primary fibers constituting it falls between 1.8 mm and 10 mm at the peak of its self-weighted, average fiber length distribution profile curve, and that the microfibers having a length of at most 1 mm account for from 0.1 to 65% by mass of the self-weight of the fibrillated rayon.

Also preferably, the water-decomposable fibrous sheet has a multi-layered structure containing the fibrillated rayon in at least one of two surface layers.

The fibrous sheet may be a non-woven fabric processed through water-jetting treatment, or it may be produced in a paper-making process.

Preferably, the degree of fineness of the fibrillated rayon falls between 1.1 and 1.9 dtex.

Also preferably, the weight of the fibers (this may be referred to as "Metsuke") of the fibrous sheet falls between 20 and 100 g/m$^2$.

Also preferably, the decomposability in water of the fibrous sheet, measured according to JIS P-4501, is at most 200 seconds.

Also preferably, the wet strength of the fibrous sheet is at least 1.1 N/25 mm.

Also preferably, the dry strength of the fibrous sheet is at least 3.4 N/25 mm.

The water-decomposable fibrous sheet of the invention can be produced according to a method that comprises;

(A) a step of sheeting fibers into a fibrous web, in which the fibers contain fibrillated rayon that comprises primary fibers having a predetermined fiber length and microfibers extending from the primary fibers and has a degree of beating of at most 700 cc, and (B) a step of pressing the fibrous web under heat while the surface of the fibrous web is wetted with water, whereby the microfibers existing in the surface are hydrogen-bonded to at least either of other microfibers and other fibers therein.

The production method may include a step (C) of processing the fibrous web through water-jetting treatment between the step (A) and the step (B).

DESCRIPTION OF THE PREFERRED EMBODIMENTS

The fibrillated rayon for use in the invention is meant to indicate fibers of regenerated cellulose rayon having finely-fibrillated surfaces, or that is, those with submicron-sized microfibers having peeled and extending from the surfaces of the primary fibers (of the fibrillated rayon). The surface of ordinary regenerated cellulose is smooth, while that of the fibrillated rayon is fibrillated; and the two have different structures.

The fibrillated fibers of that type can be produced, for example, by mechanically processing rayon while it has absorbed water and is still wetted. Concretely, they may be produced, for example, according to a method of strongly stirring rayon in water in a mixer, or a method of beating rayon in a pulper, a refiner, a beater or the like (this is a wet-beating method). More precisely, the fibrillated rayon includes fibers as produced by processing wet-spun rayon such as polynosic or the like with an acid followed by mechanically fibrillating it, and fibers as produced by mechanically fibrillating solvent-spun rayon, etc. Apart from those, the fibrillated rayon can also be produced from ordinary, wet-spun regenerated cellulose.

To specifically define the fibrillated rayon capable of being preferably used in the invention, some methods may be employed. One is to analyze the self-weighted, average fiber length distribution (the mass distribution) of the primary fibers and the microfibers constituting fibrillated rayon. The self-weighted, average fiber length may be referred to as the weighted average length by weight. The microfibers are shorter than the primary fibers. Therefore, analyzing the distribution of the fiber length in fibrillated rayon clarifies the self-weighted, average fiber length distribution of the primary fibers and the microfibers constituting the fibrillated rayon. Another method of specifically defining the intended fibrillated rayon is based on the degree of beating rayon into fibrillated rayon (CSF; Canadian Standard Freeness).

Figure 1:
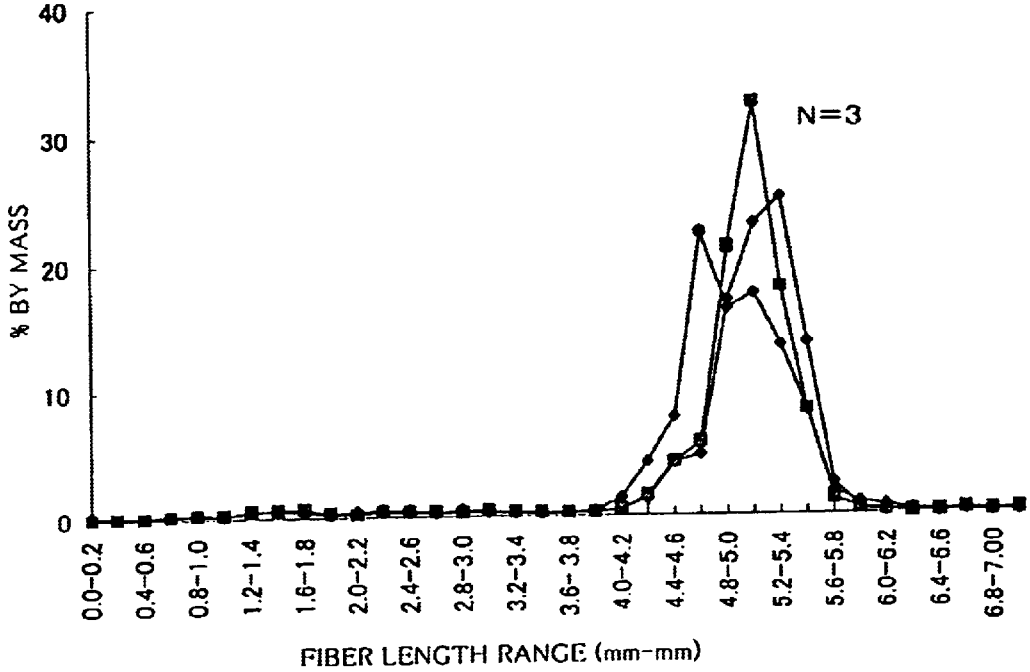
FIG. 1 is a graph showing the self-weighted, average fiber length distribution profile of the fiber length of non-beaten rayon.

First described is the mass distribution of the primary fibers and the microfibers constituting fibrillated rayon. For this, referred to is one example of beating rayon of which the original fiber length is 5 mm, into fibrillated rayon. The self-weighted, average fiber length distribution profile of non-beaten, non-fibrillated rayon (CSF=740 cc, fiber length 5 mm, 1.7 dtex), for which n=3, is shown in FIG. 1. As in FIG. 1, the mass distribution in non-beaten rayon is almost concentrated in the fiber length range of 5 mm±1 mm or so. Non-beaten rayon samples all having a concentration of 0.75% by mass were prepared and beaten in wet to different degrees in a mixer. The self-weighted, average fiber length distribution of the thus-beaten, fibrillated rayon was analyzed in relation to the different fiber lengths. The resulting data are plotted to give a graph of FIG. 2.

Figure 2:
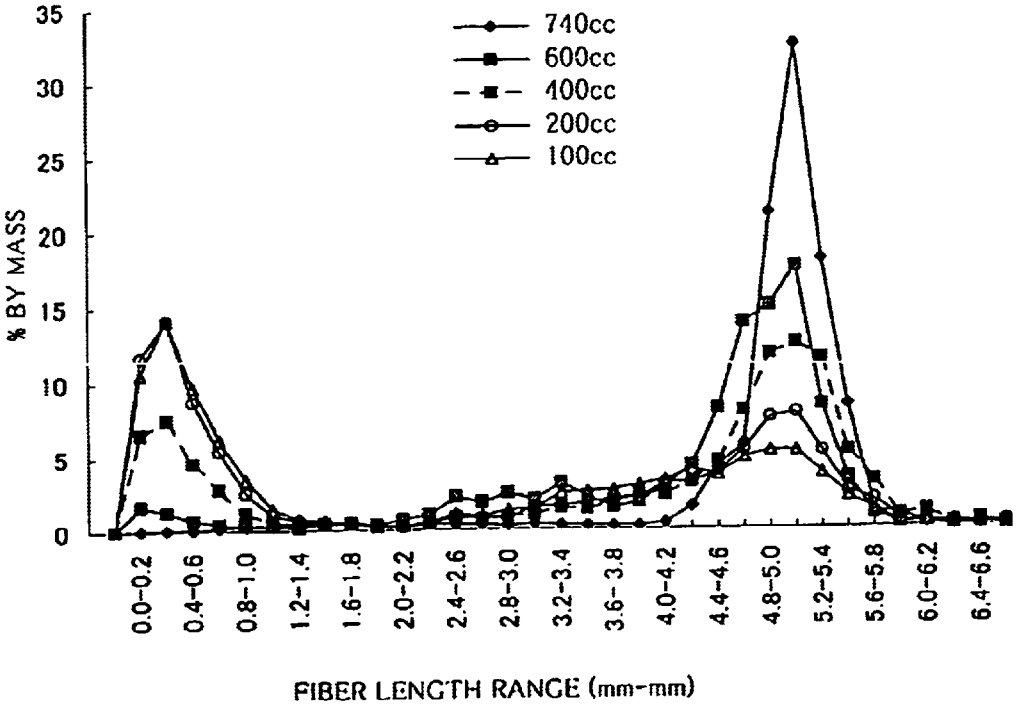
FIG. 2 is a graph showing the self-weighted, average fiber length distribution profile of the fiber length of beaten rayon, for which rayon having a fiber length of 5 mm was beaten.

As seen in FIG. 2, the mass distribution profile of the fibrillated rayon gave two apparent peaks. Regarding its details, the area except that for fiber lengths of shorter than 1 mm is principally for the primary fibers of the fibrillated rayon, and the remaining area for fiber lengths of shorter than 1 mm includes long extending microfibers and chopped rayon fibers all resulting from too much promoted fibrillation. The fiber length of the primary fibers of the beaten, fibrillated rayon may be shorter in some degree than that of the fibers of the original, non-beaten rayon, or may be seemingly longer in some degree owing to the microfibers that extend from the primary fibers at their ends. Accordingly, in the beaten, fibrillated rayon, the fiber length of the primary fibers corresponding to the peak of the mass distribution profile and around it falls within a range of the nominal fiber length of the non-beaten rayon ±0.5 mm or so, more precisely, within a range of from −0.3 mm to +0.1 mm or so relative to the nominal fiber length of the non-beaten rayon.

Figure 3:
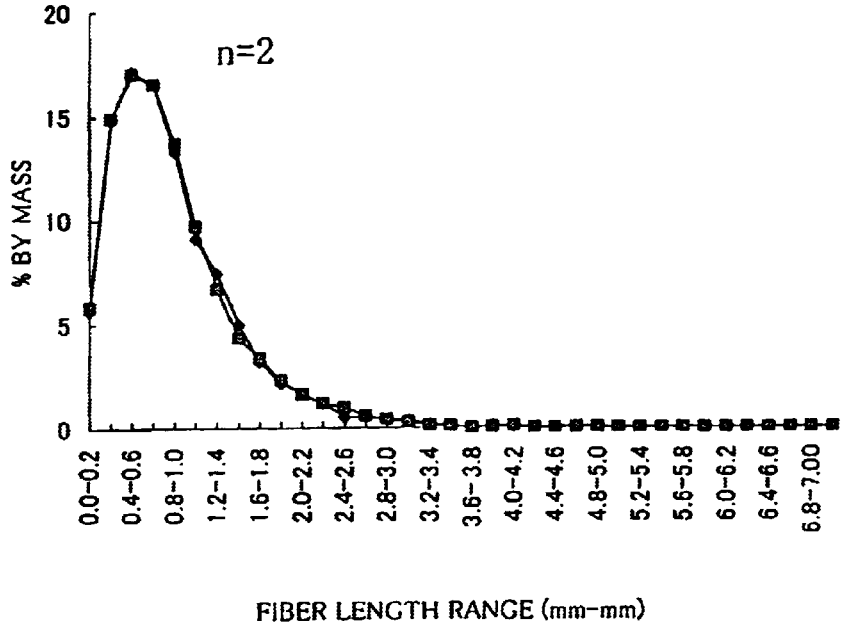
FIG. 3 is a graph showing the self-weighted, average fiber length distribution profile of the fiber length of rayon having been free-beaten.
Figure 4:
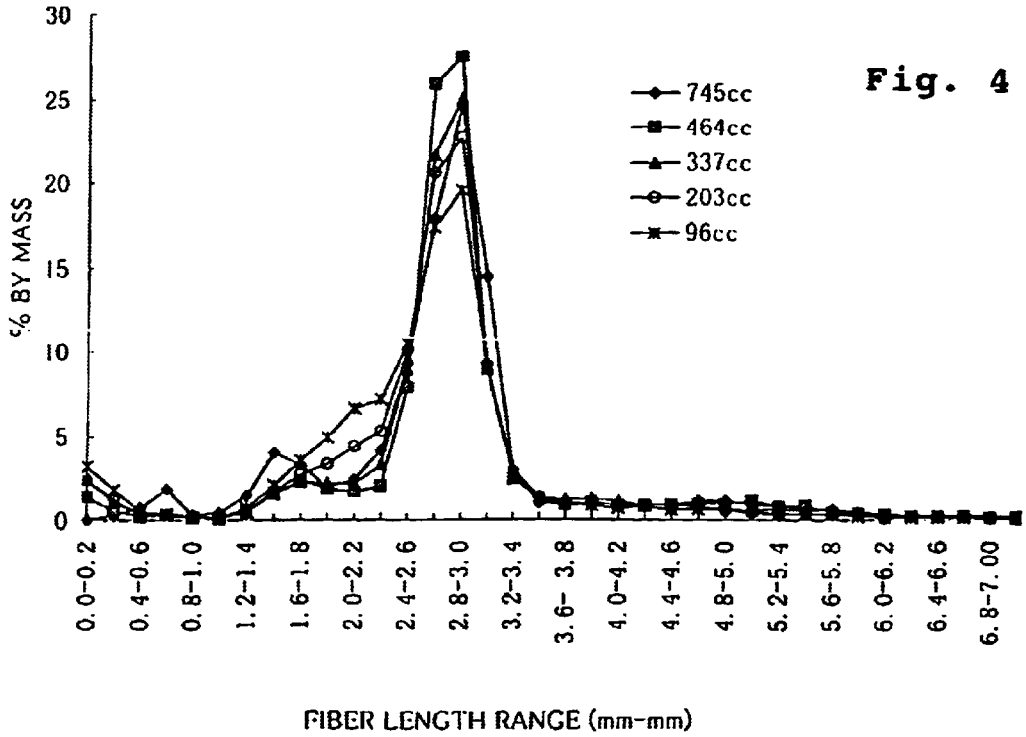
FIG. 4 is a graph showing the self-weighted, average fiber length distribution profile of the fiber length of beaten rayon, for which rayon having a fiber length of 3 mm was beaten in wet.
Figure 5:
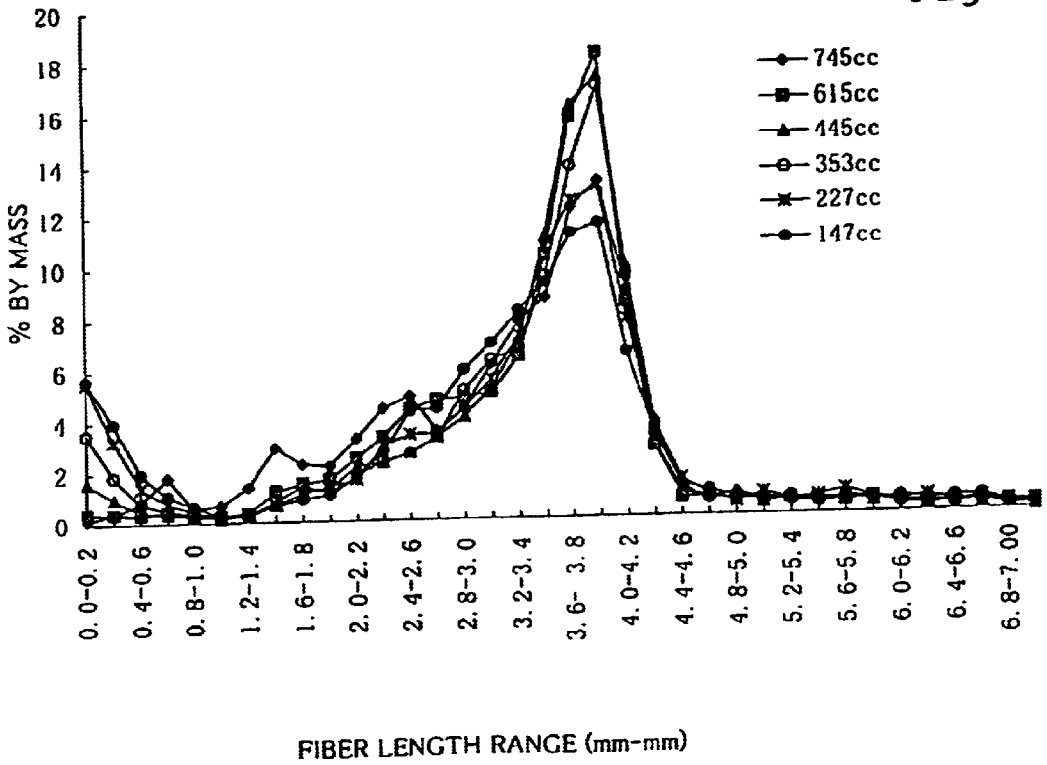
FIG. 5 is a graph showing the self-weighted, average fiber length distribution profile of the fiber length of beaten rayon, for which rayon having a fiber length of 4 mm was beaten in wet.
Figure 6:
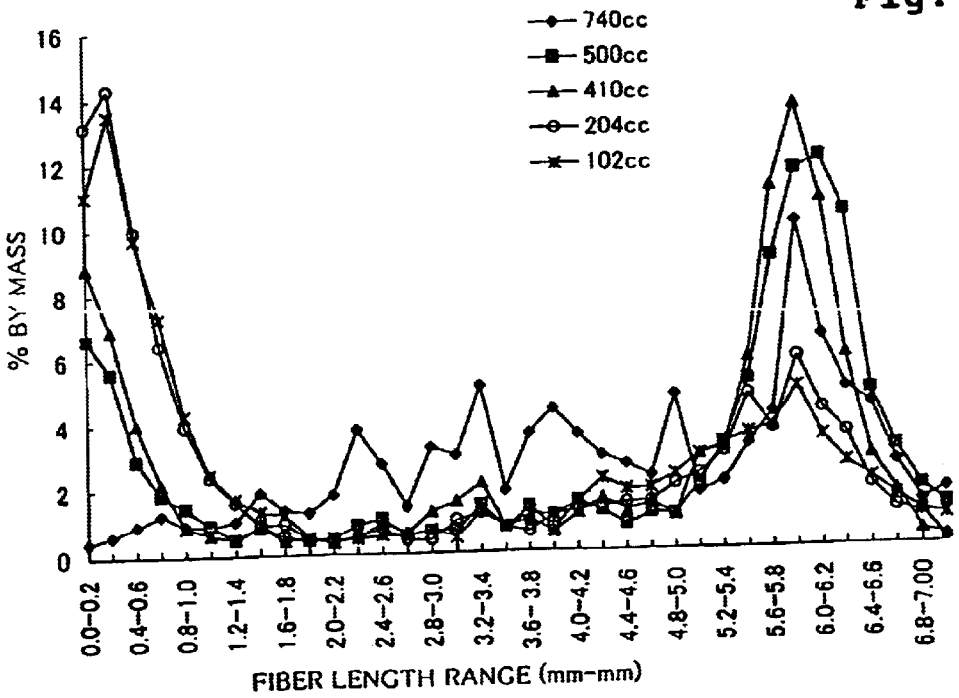
FIG. 6 is a graph showing the self-weighted, average fiber length distribution profile of the fiber length of beaten rayon, for which rayon having a fiber length of 6 mm was beaten in wet.
Figure 7:
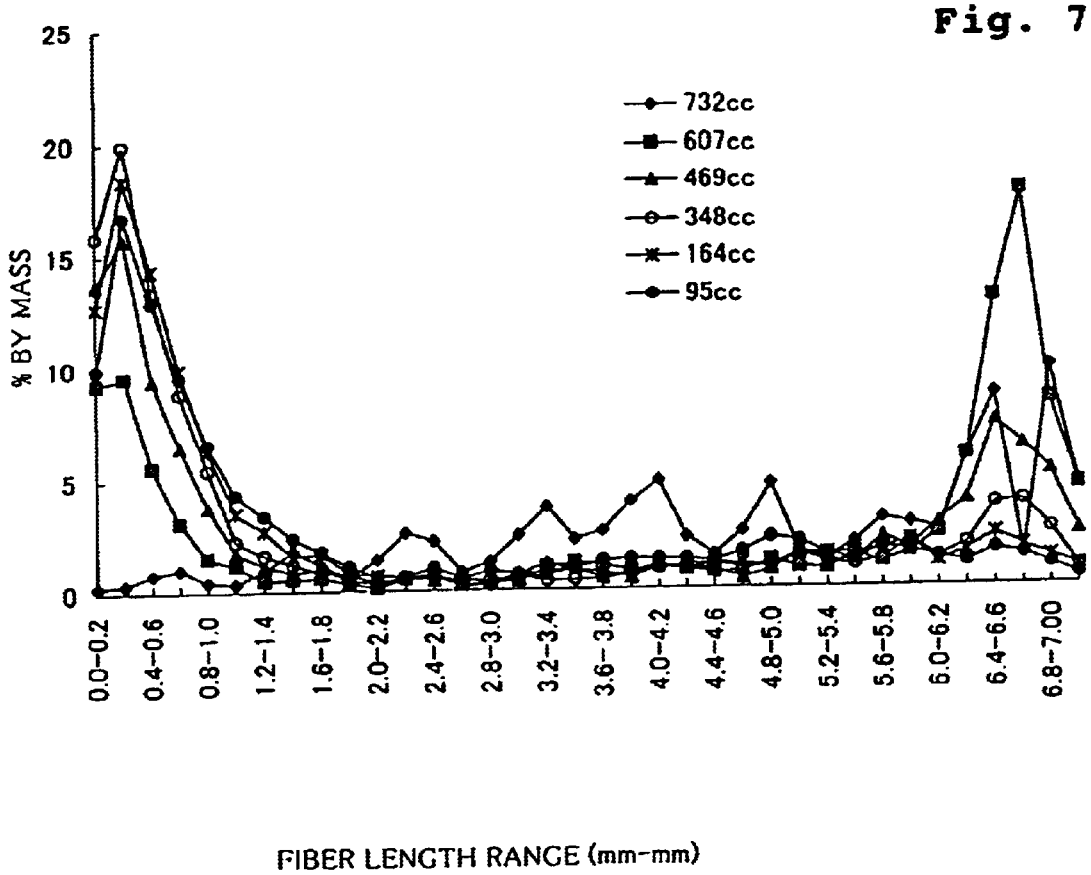
FIG. 7 is a graph showing the self-weighted, average fiber length distribution profile of the fiber length of beaten rayon, for which rayon having a fiber length of 7 mm was beaten in wet.

To that effect, the fibrillated rayon for use in the invention is identified as one having the fiber length peak for the primary fibers of the fibrillated rayon itself and the fiber length peak for the fibrillated microfibers. The fibrillated rayon is prepared by beating rayon in wet, as in the above. If, being different from this, rayon is beaten in an ordinary free-beating manner to promote its beating (so that the beaten rayon shall have a reduced numerical value indicating its degree of beating), it will be entirely pulverized into small particles, as in FIG. 3. In that condition, most of the small particles would lose the original fiber length. The free-beaten rayon is not within the scope of the fibrillated rayon for use in the invention.

Regarding the ratio of the microfibers to the fibrillated rayon preferred for use in the invention, it is desirable that the microfibers extending from the primary fibers of the fibrillated rayon and having a length of at most 1 mm account for from 0.1 to 65% by mass, more preferably from 3 to 65% by mass of the self-weight of the fibrillated rayon. Also preferably, the fiber length of the primary fibers that give the peak in the self-weighted, average fiber length distribution profile of the fibrillated rayon falls between 1.8 mm and 10.0 mm. The fibrillated rayon having the preferred morphology may be obtained by beating rayon, of which the original fiber length falls between 2.0 mm and 10.5 mm, to a degree of at most 700 cc.

The self-weighted, average fiber length distribution of fibrillated rayon depends on both the original fiber length of the non-beaten rayon and on the degree of beating the non-beaten rayon. For other preferred examples of the fibrillated rayon for use in the invention, rayon having a different fiber length of 3 mm, 4 mm, 6 mm or 7 mm was beaten in wet in a mixer, with varying the degree of beating it, and the self-weighted, average fiber length distribution of the beaten rayon relative to the varying fiber length of the beaten rayon was analyzed. The data were plotted to give the graphs of FIG. 4 to FIG. 7. Of the beaten rayon samples whose data are plotted as in the graphs of FIG. 2 and FIGS. 4 to 7, the mass distribution of the microfibers having a length of at most 1 mm and the mass distribution of the primary fibers whose length is near to the original fiber length of the non-beaten rayon (but having varied within a range of from −0.6 mm to +0.2 mm or +0.4 mm) are given in Table 1 below. The samples having degree of beating of 740 cc or 732 cc are non-beaten samples.

TABLE 1

| | Degree of Beating (cc) | not longer than 1.0 mm (% by mass) | |
|---|---|---|---|
| | | | 2.4 to 3.4 mm (% by mass) |
| 3 mm | 745 | 3.36 | 60.33 |
| | 464 | 2.61 | 72.84 |
| | 337 | 4.40 | 67.89 |
| | 203 | 4.49 | 65.35 |
| | 96 | 6.31 | 58.86 |
| | | | 3.4 to 4.4 mm (% by mass) |
| 4 mm | 745 | 3.78 | 45.66 |
| | 615 | 1.85 | 55.19 |
| | 445 | 3.70 | 58.02 |
| | 353 | 7.02 | 59.58 |
| | 227 | 11.47 | 47.23 |
| | 147 | 13.28 | 41.51 |

TABLE 1-continued

| | Degree of Beating (cc) | not longer than 1.0 mm (% by mass) | |
|---|---|---|---|
| | | | 4.4 to 5.4 mm (% by mass) |
| 5 mm | 740 | 0.69 | 76.56 |
| | 600 | 4.06 | 63.80 |
| | 400 | 22.49 | 47.25 |
| | 200 | 35.95 | 32.77 |
| | 100 | 41.76 | 22.72 |
| | | | 5.4 to 6.4 mm (% by mass) |
| 6 mm | 740 | 4.19 | 28.64 |
| | 500 | 18.45 | 47.78 |
| | 410 | 22.90 | 46.98 |
| | 204 | 47.74 | 21.85 |
| | 102 | 45.81 | 18.12 |
| | | | 6.4 to 7.2 mm (% by mass) |
| 7 mm | 732 | 2.83 | 34.29 |
| | 607 | 28.98 | 43.07 |
| | 469 | 49.06 | 24.96 |
| | 348 | 63.29 | 10.72 |
| | 164 | 61.53 | 6.19 |
| | 95 | 55.58 | 4.39 |

Other preferred examples of the fibrillated rayon for use in the invention are shown in Table 2, Table 3 and Table 4. The data in these Tables indicate the proportion of the microfibers not longer than 1.0 mm in each fibrillated rayon sample having been prepared by beating rayon to different degrees of beating. For the samples in Table 2, rayon of originally 5 mm in length and 1.7 dtex in fineness was beaten to different degrees in a mixer; for those in Table 3, rayon of originally 3 mm in length and 1.4 dtex in fineness, or rayon of originally 3 mm in length and 1.7 dtex in fineness was beaten to different degrees in a pulper or a refiner; and for those in Table 4, rayon of originally 5 mm in length and 1.4 dtex in fineness, or rayon of originally 5 mm in length and 1.7 dtex in fineness was beaten to different degrees in a pulper or a refiner.

TABLE 2

| | Degree of Beating (cc) | not longer than 1.0 mm (% by mass) |
|---|---|---|
| 5 mm 1.7 dtex | 740 | 0.69 |
| | 520 | 12.77 |
| | 377 | 23.20 |
| | 185 | 39.37 |
| | 67 | 35.47 |

TABLE 3

| | Degree of Beating (cc) | not longer than 1.0 mm (% by mass) | | Degree of Beating (cc) | not longer than 1.0 mm (% by mass) |
|---|---|---|---|---|---|
| 3 mm 1.4 dtex | 644 | 0.57 | 3 m 1.7 dtex | 653 | 0.16 |
| | 626 | 0.46 | | 584 | 0.23 |
| | 595 | 0.40 | | 472 | 0.43 |
| | 563 | 0.78 | | 372 | 0.59 |
| | 480 | 0.71 | | 333 | 0.63 |
| | 407 | 0.69 | | 291 | 1.13 |
| | 352 | 0.87 | | 259 | 1.25 |
| | 340 | 1.05 | | 212 | 1.54 |
| | 297 | 1.32 | | 176 | 1.92 |

TABLE 3-continued

| Degree of Beating (cc) | not longer than 1.0 mm (% by mass) | Degree of Beating (cc) | not longer than 1.0 mm (% by mass) |
|---|---|---|---|
| 241 | 1.39 | 163 | 3.61 |
| 211 | 1.77 | | |

TABLE 4

| | Degree of Beating (cc) | not longer than 1.0 mm (% by mass) | | Degree of Beating (cc) | not longer than 1.0 mm (% by mass) |
|---|---|---|---|---|---|
| 5 mm 1.4 dtex | 676 | 1.08 | 5 mm 1.7 dtex | 695 | 0.47 |
| | 646 | 1.06 | | 625 | 1.49 |
| | 631 | 2.08 | | 521 | 7.17 |
| | 554 | 8.48 | | 229 | 20.96 |
| | 433 | 7.39 | | 200 | 17.14 |
| | 339 | 11.18 | | 198 | 20.04 |
| | 242 | 21.57 | | 198 | 18.10 |
| | 183 | 20.43 | | 198 | 17.59 |
| | 161 | 26.55 | | 195 | 16.92 |
| | 135 | 24.32 | | 195 | 15.08 |
| | | | | 190 | 15.14 |
| | | | | 188 | 19.54 |
| | | | | 187 | 17.41 |
| | | | | 186 | 13.94 |

As in the above-mentioned Tables, in the fibrillated rayon samples from non-beaten rayon having a fiber length of 3 mm (in these, the mass distribution peak for the primary fibers appears within a fiber length range of 3±0.5 mm), the microfibers having a length of at most 1 mm account for from 0.1 to 10% by mass of the self-weight of the fibrillated rayon. However, in the samples having been beaten in a pulper or a refiner, the uppermost limit of the microfibers is 5% by mass or so; and in those having been beaten in a pulper or a refiner to a degree of beating of at most 600 cc, the lowermost limit thereof is 0.2% by mass.

In the fibrillated rayon samples from non-beaten rayon having a fiber length of 4 mm (in these, the mass distribution peak for the primary fibers appears within a fiber length range of 4±0.5 mm), the microfibers having a length of at most 1 mm account for from 1 to 14% by mass of the self-weight of the fibrillated rayon. However, in the samples having been beaten in a pulper or a refiner, the microfibers account for from 0.3 to 10% by mass or so; and in those having been beaten in a pulper or a refiner to a degree of beating of at most 600 cc, the lowermost limit of the microfibers is 0.5% by mass.

In the fibrillated rayon samples from non-beaten rayon having a fiber length of 5 mm (in these, the mass, distribution peak for the primary fibers appears within a fiber length range of 5±0.5 mm), the microfibers having a length of at most 1 mm account for from 0.3 to 45% by mass of the self-weight of the fibrillated rayon. However, in the samples having been beaten in a pulper or a refiner the uppermost limit of the microfibers is 30% by mass or so; and in those having been beaten in a pulper or a refiner to a degree of beating of at most 600 cc, the lowermost limit thereof is 5% by mass.

In the fibrillated rayon samples from non-beaten rayon having a fiber length of 6 mm (in these, the mass distribution peak for the primary fibers appears within a fiber length range of 6±0.5 mm), the microfibers having a length of at most 1 mm account for from 5 to 50% by mass of the self-weight of the fibrillated rayon. However, in the samples having been beaten in a pulper or a refiner, the microfibers account for from 0.5 to 30% by mass or so; and in those having been beaten in a pulper or a refiner to a degree of beating of at most 600 cc, the lowermost limit of the microfibers is 5% by mass.

In the fibrillated rayon samples from non-beaten rayon having a fiber length of 7 mm (in these, the mass distribution peak for the primary fibers appears within a fiber length range of 7±0.5 mm), the microfibers having a length of at most 1 mm account for from 10 to 65% by mass of the self-weight of the fibrillated rayon. However, in the samples having been beaten in a pulper or a refiner, the microfibers account for from 3 to 50% by mass or so; and in those having been beaten in a pulper or a refiner to a degree of beating of at most 600 cc, the lowermost limit of the microfibers is 8% by mass.

The above are summarized as follows: In case where rayon having an original fiber length of from 3 mm to smaller than 5 mm is beaten (in this case, the mass distribution peak for the primary fibers of the resulting, beaten rayon appears within a fiber length range of from 2.5 mm to smaller than 4.5 mm) and where the degree of beating is smaller than 400 cc, the microfibers having a length of at most 1 mm account for from 0.5 to 15% by mass of the self-weight (that is, the total mass) of the fibrillated rayon. However, in case where the rayon is beaten in a pulper or a refiner, the uppermost limit of the microfibers is 8% by mass or so. On the other hand, in case where the rayon is beaten to a degree of from 400 cc to 700 cc, the microfibers having a length of at most 1 mm account for from 0.1 to 5% by mass of the self-weight of the fibrillated rayon. However, in case where the rayon is beaten in a pulper or a refiner to such a degree, the uppermost limit of the microfibers is 3% by mass or so. Still on the other hand, in case where the rayon is beaten in a pulper or refiner to a degree of from 400 cc to 600 cc, the lowermost limit of the microfibers is 0.2% by mass.

In case where rayon having an original fiber length of from 5 mm to 7 mm is beaten (in this case, the mass distribution peak for the primary fibers of the resulting, beaten rayon appears within a fiber length range of from 4.5 mm to 7.5 mm) and where the degree of beating is smaller than 400 cc, the microfibers having a length of at most 1 mm account for from 8 to 65% by mass of the self-weight of the fibrillated rayon. However, in case where the rayon is beaten in a pulper or a refiner, the uppermost limit of the microfibers is 30% by mass or so and the lowermost limit thereof can be 5% by mass. On the other hand, in case where the rayon is beaten to a degree of from 400 cc to 700 cc, the microfibers having a length of at most 1 mm account for from 0.3 to 50% by mass of the self-weight of the fibrillated rayon. However, in case where the rayon is beaten in a pulper or a refiner to such a degree, the uppermost limit of the microfibers is 20% by mass or so. Still on the other hand, in case where the rayon is beaten in a pulper or refiner to a degree of from 400 cc to 600 cc, the lowermost limit of the microfibers is 2% by mass.

The degree of beating of the fibrillated rayon preferred for use in the invention is described. The degree of beating to give fibrillated rayon can be controlled by varying the beating time and by selecting the beating means. Where beating rayon is promoted (to give a beaten, fibrillated rayon that shall have a lowered numerical value indicating its degree of beating), the ratio of short fibers (including microfibers) in mass distribution of the resulting fibrillated rayon will increase. In the invention, the fibrillated rayon has a degree of beating of at most 700 cc. Fibrillated rayon having a degree of beating of larger than 700 cc contains a small amount of microfibers formed therein and therefore could not have a strength necessary for the water-decomposable fibrous sheet of the invention. More preferably, the fibrillated rayon for use herein has a degree of beating of at most 600 cc in order that it can contain a suitable amount of microfibers formed therein. The fibrillated rayon of that type is preferred, since the microfibers constituting it significantly enhance the strength of the fibrous sheet that comprises it. Even more preferably, the degree of beating is at most 400 cc. Even when fibrillated rayon having a degree of beating of at most 200 cc, or even at most 100 cc (for example, 50 cc or 0 cc) is used for sheet production, the water-decomposable fibrous sheet produced and comprising it could have well-balanced wet strength and decomposability in water.

However, in case where fibrillated rayon having been too much beaten (thereby having a too much reduced numerical value indicating its degree of beating), for example, that having a degree of being of 0 cc is used in sheet production, the degree of water filtration through sheets being produced will be low. Therefore, it is desirable to combine the fibrillated rayon of that type with other fibers to produce fibrous sheets. In this case, the proportion of the fibrillated rayon is preferably at most 30%, more preferably at most 20%. Also preferably, the (original) fiber length of the non-beaten rayon to give the fibrillated rayon is at most 6 mm, more preferably at most 5 mm.

The fineness of the fibrillated rayon (in terms of denier) is preferably from 1 to 7 d (denier), that is, from 1.1 to 7.7 dtex or so. If its fineness is smaller than the lowermost limit of the defined range, the primary fibers of the fibrillated rayon will be too much entangled, and the decomposability in water of the fibrous sheet comprising it will be poor. On the other hand, if its fineness is larger than the uppermost limit of the defined range, the formation of the fibrous sheet will be not good and, in addition, the productivity thereof will be low. More preferably, the fineness falls between 1.1 and 1.9 dtex.

The water-decomposable fibrous sheet of the invention may be made from only the fibrillated rayon, but may contain any other fibers having a length of at most 10 mm, in addition to it. In the fibrous sheet comprising the fibrillated rayon and other fibers, the microfibers of the fibrillated rayon could be entangled with the other fibers, thereby ensuring the strength of the sheet. The entangled microfibers and other fibers are readily loosened when a large amount of water is applied to the sheet, therefore ensuring good decomposability of the sheet in water.

Preferably, the other fibers having a length of at most 10 mm are well dispersible in water, or that is, water-dispersible fibers are preferred for them. The dispersibility in water referred to herein has the same meaning as the composability in water, and is meant to indicate that the fibers are dispersed well in water to thereby decompose the sheet comprising them, when kept in contact with a large amount of water. More preferably, the other fibers are biodegradable fibers. The biodegradable fibers naturally decompose by themselves when disposed of in the natural world. The fiber length of the other fibers for use herein is meant to indicate the mean fiber length thereof. Further preferably, the other fibers having a fiber length of at most 10 mm have a length (in terms of the mean fiber length) of at least 1 mm.

The other fibers for use in the invention may be those of at least one sort selected from the group consisting of natural fibers and chemical fibers. The natural fibers include those from wood pulp such as soft wood pulp, hard wood pulp, etc.; and also those from Manila hemp, linter pulp, etc. These natural fibers are biodegradable. Of those, preferred are bleached soft-wood kraft pulp, and bleached hard-wood kraft pulp, as having high dispersibility in water. Also usable herein are chemical fibers such as regenerated fibers of rayon, etc.; synthetic fibers of polypropylene, polyvinyl alcohol, polyester, polyacrylonitrile, etc.; biodegradable synthetic fibers; synthetic pulp of polyethylene, etc. Of those, preferred is rayon, as being biodegradable. Further usable are still other biodegradable fibers of polylactic acid, polycaprolactone, aliphatic polyesters such as polybutylene succinate, polyvinyl alcohol collaqen, etc. Needless-to-say, any fibers other than those mentioned above are usable herein so far as they are dispersible in water,.

For the soft wood pulp, its degree of beating preferably falls between 500 and 750 cc or so. If its degree of beating is smaller than the lowermost limit of the defined range, the non-woven fabric comprising the pulp will have a paper-like morphology, and will have a rough feel. If, however, its degree of beating is larger than the uppermost limit of the defined range, the non-woven fabric comprising the pulp could not have the necessary strength.

In case where the fibrous sheet of the invention contains other fibers such as those as above, it is desirable that the fibrillated rayon content of the sheet is at least 3% by mass of all fibers constituting the sheet and the other fibers account for at most 97% by mass thereof. More preferably, the fibrillated rayon content of the sheet is at least 10% by mass, and the other fibers account for at most 90% by mass; even more preferably the fibrillated rayon content of the sheet is at least 20% by mass, and the other fibers account for at most 80% by mass.

The fibers mentioned above are formed into the fibrous sheet of the invention. For example, they are formed into a fibrous web in a paper-making process or the like, and optionally the fibrous web is further processed with water jets into a non-woven fabric. The fibrous sheet of the invention may be any of such fibrous webs or non-woven fabrics. In the fibrous sheet, the microfibers extending from the surfaces of the fibrillated rayon fibers could be entangled with other microfibers and other fibers, thereby enhancing the strength of the sheet. The entangled microfibers are readily loosened when a large amount of water is applied to the sheet, and therefore the sheet enjoys increased decomposition in water. In addition, the sheet surface contains many microfibers, and the microfibers therein are principally brought into direct contact with the surfaces of other objects. Accordingly, the overall friction that the fibrous sheet will directly receive during use will be reduced, and the surface of the water-decomposable fibrous sheet of the invention is highly resistant to friction.

The dry surface friction resistance of the water-decomposable fibrous sheet of the invention, measured according to the abrasion resistance test method for dry paper boards in JIS P-8136, is at least three rubbing cycles. Briefly, in the test method of JIS P-8136, a test piece (fibrous sheet) is fitted onto a slide stand (B), and a rubbing member (A) with a piece of artificial leather attached thereto is rubbed against the test piece. The number of rubbing cycles is counted before fibers are peeled off to form roundish fibrous fluffs on the surface of the test piece. Preferably, the fibrous sheet of the invention is resistant to at least ten rubbing cycles in the test.

Also preferably, the wet surface friction resistance of the water-decomposable fibrous sheet of the invention is at least three rubbing cycles. For wiper sheets and absorbent articles, the fibrous sheet must be resistant to surface friction even in wet in some degree. The fibrous sheet in wet contains water of at least 2.5 times the self-weight of the dry sheet. In the water-decomposable fibrous sheet of the invention, the microfibers extending from the surfaces of the fibrillated rayon fibers constituting the sheet are entangled and the fibers are therefore bonded together to a suitable degree. Accordingly, even in wet, the sheet is still resistant to surface friction. More preferably, the fibrous sheet of the invention is, even in wet, still resistant to at least ten rubbing cycles in the test.

The water-decomposable fibrous sheet of the invention may be used directly after it has been produced in a wet paper-making process or the like. The dry strength of the water-decomposable fibrous sheet could be specifically increased owing to the hydrogen bonding at the OH groups existing on the surfaces of the fibrillated rayon fibers in the sheet. With the increase in the degree of fibrillation of rayon fibers in the sheet, or that is, with the increase in the amount of microfibers therein, the surface area of the fibers constituting the sheet increases and the fiber-to-fiber bonding strength of hydrogen bonds in the sheet is thereby enhanced. In the sheet produced in a paper-making process and not processed with water jets, the hydrogen-bonding force of the microfibers is comparable to or larger than that of pulp, and the sheet strength is high. Depending on the hydrogen-bonding force of the microfibers constituting the sheet, the decomposability in water of the sheet could be well balanced with the mechanical strength thereof. The dry strength of the sheet produced in a paper-making process is especially high. Even in the sheet produced in a paper-making process, the microfibers can be partly entangled, and the wet strength of the sheet can be high.

For more surely increasing its wet strength, the fibrous sheet is preferably in the form of a non-woven fabric that may be produced by forming a fibrous web, for example, in a wet process, followed by subjecting the fibrous web to water-jetting treatment. The fibrous web may also be prepared in a dry process, and may be subjected to water-jetting treatment. For water-jetting treatment, employed is an ordinary high-pressure water-jetting device. Through water-jetting treatment, the microfibers extending from the fibrillated rayon in the thus-processed fibrous web are entangled with at least either of other microfibers and other fibers, thereby increasing the tangling fiber-to-fiber force therein, and the dry strength of the processed fibrous web increases owing to the hydrogen-bonding force of the microfibers. Even though the hydrogen bonds therein are broken when the fibrous web is wetted, the fibrous web could still keep high wet strength as the microfibers therein are kept entangled. Through water-jetting treatment, the microfibers existing on the surfaces of the fibrillated rayon fibers are entangled with other fibers or microfibers. Accordingly, the fiber-tangling structure of the non-woven fabric having been processed through water-jetting treatment differs from that of an ordinary non-woven spun lace fabric in which the constituent fibers are entangled together by themselves.

Figure 8:
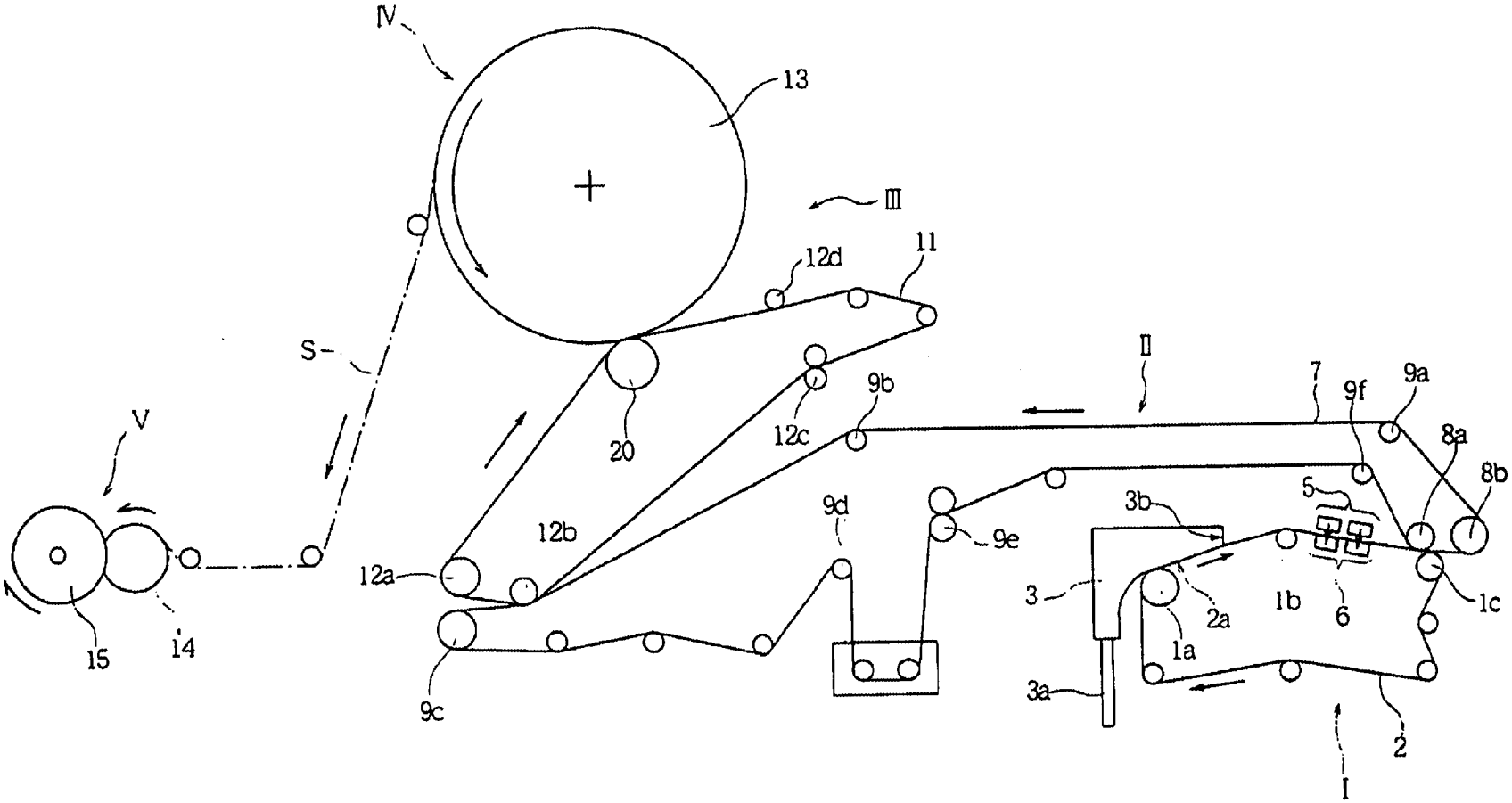
FIG. 8 is a schematic view showing one embodiment of the method and apparatus for producing the water-decomposable fibrous sheet of the invention.

FIG. 8 is an overall schematic view showing one embodiment of the method and apparatus for producing the water-decomposable fibrous sheet (wet-process non-woven fabric) of the invention through water-jetting treatment. The apparatus for producing a non-woven fabric in a wet process of FIG. 8 comprises a non-woven fabric-forming unit I, a felt conveyor unit II, a transfer unit III combined with a latter-stage felt conveyor unit in which the non-woven fabric formed is transferred onto a drying drum, a drier unit IV for surface treatment, and a winder unit V. The non-woven fabric-forming unit I is equipped with a wire conveyor belt 2, which is clockwise rotated at a predetermined speed while being held by a plurality of rolls 1*a*, 1*b*, 1*c*, etc.

The wire conveyor belt 2 faces a stock feeder 3 above its up-rising area 2*a* between the roll 1*a* and the roll 1*b*, and faces a dewatering tank (not shown) below the up-rising area 2*a*. Into the stock feeder 3, fibers and water are supplied through a supply port 3*a*. The fibers fed from the stock feeder 3 onto the wire conveyor belt 2 is attracted to the wire conveyor belt 2 by the air suction force of the dewatering tank below the up-rising area 2*a*. The stock feeder 3 is adjacent to a heel slice 3*b* that faces the wire conveyor belt 2 via a gap therebetween, and the gap between the wire conveyor belt 2 and the heel slice 3*b* serves to form a fibrous web having a predetermined thickness on the wire conveyor belt 2.

Between the rolls 1*b* and 1*c*, a single-stage or multi-stage water-jetting nozzle 5 is disposed above the wire conveyor belt 2, and it faces a dewatering tank 6 disposed below the wire conveyor belt 2. To the fibrous web having passed through the gap at the heel slice 3*b* and formed on the wire conveyor belt 2, water jets are applied through the water-jetting nozzle 5. As a result of the water-jetting treatment, the fibers of the fibrous web, especially the microfibers extending from the fibrillated rayon fibers in the web are entangled, and the intended non-woven fabric (fibrous sheet) S is produced.

The wire conveyor belt 2 is contacted with a felt conveyor belt 7 in the felt conveyor unit (felt part) II. The felt conveyor belt 7 is made of a needled blanket, and its texture roughness differs from that of the wire conveyor belt 2. Therefore, the non-woven spun lace fabric S formed on the wire conveyor belt 2 is transferred onto the felt conveyor belt 7. In the felt conveyor unit II, a roll 8*a* is an air suction transfer means, or that is, a suction pick-up roll, via which, therefore, the non-woven fabric S is readily transferred from the wire conveyor belt 2 onto the felt conveyor belt 7. In the felt conveyor unit II, the felt conveyor belt 7 is rotated counterclockwise while being held by the rolls 8*a* and 8*b* and by other rolls 9*a*, 9*b*, 9*c*, 9*d*, 9*e*, 9*f*, etc.

In the latter-stage felt conveyor unit, disposed is a second felt conveyor belt 11. Like the felt conveyor belt 7, the second felt conveyor belt 11 is made of a needled blanket, and this is held by a plurality of rolls 12*a*, 12*b*, 12*c* and 12*d*. Around a pressure roll 20 in the unit, the felt conveyor belt 11 meets a drier drum 13, and the non-woven fabric on the second felt conveyor belt 11 is transferred onto the drier drum 13. In the drier unit IV for surface treatment, the non-woven fabric S is thus wound around the drier drum 13, and dried thereon. After having been thus dried, the non-woven fabric S is wound up by a winder roll 14 into a roll 15. Through the process, producing the fibrous sheet as a roll is finished.

To further enhance its surface friction resistance, the fibrous sheet of the invention is preferably further processed for skin formation, for which the sheet is heated under pressure while its surface is still wet. Through skin formation treatment, the amount of the hydrogen-bonded microfibers in the sheet could be increased. In the method mentioned above, the surface of the drier drum 13 is smooth and is heated.

In the transfer unit III, the non-woven fabric S is pressed between the pressure roll 20 and the drier drum 13. In this step, the non-woven fabric S contains water having been applied thereto through water-jetting treatment, and, while it is pressed against the drier drum 13, the water therein is vaporized away by the heat of the drier drum 13. In addition, while the non-woven fabric S is pressed under heat against the drier drum 13, the fibers constituting the surface of the non-woven fabric S, which is in contact with the smooth surface of the drier drum 13, are more highly bonded to each other via hydrogen bonding. In that manner, the non-woven fabric S is processed for skin formation. As a result, the microfibers extending from the fibrillated rayon in the surface of the non-woven fabric S thus having been processed for skin formation are hydrogen-bonded to each other to a higher degree than those in the surface of the non-woven fibric S not processed for the treatment. In addition, during such skin formation treatment, the non-woven fabric S is pressed against the drum so that its surface could be smoothed, and the surface strength of the thus-processed, non-woven fabric S is thereby increased. Accordingly, in its practical use, the fibrous sheet of the non-woven fabric is hardly broken even when its surface is rubbed against objects. Through skin formation treatment, the amount of the hydrogen-bonded microfibers in the fibrous sheet is much increased. As a result of skin formation treatment, therefore, the strength of the fibrous sheet is much increased not only in dry but also even in wet with a small amount of water.

Fiber-to-fiber bonds in the fibrous sheet increase through skin formation treatment, but they are readily loosened in a large amount of water, for example, when the fibrous sheet is disposed of in flush toilets, etc. Skin formation treatment increases the surface friction resistance of the fibrous sheet and even the strength of the sheet itself, but does not almost detract from the decomposability of the sheet in water.

For skin formation treatment, any device capable of heating non-woven fabrics under pressure, including, for example, embossing rolls and pressure plates may be used in place of the drier drum 13 and the pressure roll 20. Just before processed for skin formation, the surface of the non-woven fabric may be wetted with water, for example, by spraying water thereover.

In the above-mentioned embodiment, the water-decomposable fibrous sheet of the invention is, after having been processed for water-jetting treatment, further processed for skin formation. The same shall apply also to the fibrous sheet made according to a paper-making process, for processing the sheet for skin formation. Briefly, after the fibrous sheet is made according to a paper-making process, it is dried, then its surface is wetted with water, and thereafter the thus-wetted fibrous sheet is heated under pressure. The fibers, especially the microfibers existing in the surface of the thus-processed fibrous sheet are bonded through hydrogen bonding, and the surface strength of the sheet is thereby increased.

Preferably, the weight (Metsuke) of the fibrous web for the fibrous sheet of the invention falls between 20 and 100 $g/m^2$, in order that the sheet can bear wiping in wet and is favorable to the top sheet for absorbent articles. If its weight is smaller than the lowermost limit of the defined range, the sheet could not have the necessary wet strength. If, however, its weight is larger than the uppermost limit of the defined range, the sheet will be not flexible. In particular, for application to the skin of human bodies, the weight of the sheet is more preferably from 30 to 70 $g/m^2$, in view of the wet strength and the soft feel of the sheet.

The water-decomposable fibrous sheet of the invention is not limited to a single-layered one, but may be two-layered or more multi-layered ones. Of the fibrous sheet having such a multi-layered structure, one or both surfaces may contain fibrillated rayon. The surface layer of the multi-layered fibrous sheet may contain a larger amount of fibrillated rayon than the interlayer thereof. It is desirable that the multi-layered, water-decomposable fibrous sheet of the invention is also processed for skin formation as in the above, for which the sheet is pressed under heat while wetted.

Preferably, the strength at break in wet of the water-decomposable fibrous sheet of the invention that contains water is at least 1.1 N/25 mm in terms of the root mean square of the strength in the machine direction (MD) of the non-woven fabric for the sheet and that in the cross direction (CD) thereof. The strength at break in wet (this is herein referred to as wet strength) is meant to indicate the tensile strength at break (N) of the fibrous sheet in wet. To obtain its wet strength in terms of the tensile strength at break, a piece of the fibrous sheet having a width of 25 mm and a length of 150 mm is immersed in water to thereby infiltrate water of 2.5 times the mass of the sheet into the sheet piece, and the thus-wetted sheet piece is pulled until it is broken, by the use of a Tensilon tester, for which the chuck distance is 100 mm and the stress rate is 100 mm/min. However, the data thus measured according to the method are merely the criterion for the strength of the fibrous sheet, and the fibrous sheet of the invention will have a strength that is substantially the same as the wet strength thereof measured according to the test method. More preferably, the wet strength of the fibrous sheet is at least 1.3 N/25 mm.

On the other hand, it is also desirable that the fibrous sheet has high strength enough for its use even in dry. Therefore, the dry strength of the fibrous sheet is preferably at least 3.4 N/25 mm in terms of the root mean square of the strength at break in the machine direction (MD) of the non-woven fabric for the sheet and that in the cross direction (CD) thereof.

Also preferably, the water-decomposable fibrous sheet of the invention has a degree of decomposition in water of at most 300 seconds, more preferably at most 200 seconds, even more preferably at most 120 seconds. The degree of decomposition in water is measured according to the test method of JIS P-4501 that indicates the degree of easy degradation of toilet paper in water. The outline of the paper degradation test method is described. A piece of the water-decomposable fibrous sheet of the invention having a length of 10 cm and a width of 10 cm is put into a 300-ml beaker filled with 300 ml of ion-exchanged water, and stirred therein with a rotor. The revolution speed of the rotor is 600 rpm. The condition of the test piece being dispersed in water is macroscopically observed at predetermined time intervals, and the time until the test piece is finely dispersed is measured.

However, the data thus measured according to the method are merely the criterion for the decomposability in water of the fibrous sheet, and the fibrous sheet of the invention will have a degree of decomposition in water that is substantially the same as the data measured according to the test method.

To make the water-decomposable fibrous sheet of the invention have a degree of decomposition in water and a degree of wet strength that fall within the preferred ranges noted above, the type of the fibers constituting the sheet, the proportion of the fibers, the weight of the sheet, and the conditions for water-jetting treatment for the sheet may be varied. For example, in case where a large amount of fibrillated rayon having a long fiber length is used, or where fibrillated rayon not beaten so much (that is, having an increased numerical value indicating its degree of beating) is used, the weight of the fibrous sheet is reduced, or the processing energy for water-jetting treatment is reduced, whereby the fibrous sheet could have an increased degree of decomposition in water and an increased wet strength.

Even though not containing a binder, the water-decomposable fibrous sheet of the invention could have a high degree of decomposition in water and a high wet strength. However, in order to further increase the wet strength of the fibrous sheet, a water-soluble or water-swellable binder capable of binding fibers together may be added to the sheet. Having met a large amount of water, the binder shall dissolve or swell therein and therefore lose its fiber-binding ability. The binder usable herein includes, for example, carboxymethyl cellulose; alkyl celluloses such as methyl cellulose, ethyl cellulose, benzyl cellulose, etc.; polyvinyl alcohol; modified polyvinyl alcohols having a predetermined amount of a sulfonic acid group or a carboxyl group, etc. The amount of the binder to be added to the fibrous sheet may be smaller than usually. For example, only about 2 g of the binder, relative to 100 g of the fibers constituting the fibrous sheet, may be added to the sheet whereby the wet strength of the sheet could be increased to a satisfactory degree. Accordingly, adding such a small amount of a binder to the fibrous sheet does not so much interfere with the safety of the sheet. To add a water-soluble binder to the non-woven fabric for the fibrous sheet, employable is a coating method of applying the binder to the non-woven fabric through a silk screen. On the other hand, a water-swellable binder may be added to the fibrous web for the sheet while the fibrous web is prepared in a paper-making process.

Where a binder such as that mentioned above is added to the fibrous sheet of the invention, an electrolyte such as a water-soluble inorganic or organic salt may be added thereto along with the binder, whereby the wet strength of the sheet could be increased much more. The inorganic salt includes, for example, sodium sulfate, potassium sulfate, zinc sulfate, zinc nitrate, potassium alum, sodium chloride, aluminium sulfate, magnesium sulfate, potassium chloride, sodium carbonate, sodium hydrogencarbonate, ammonium carbonate, etc.; and the organic salt includes, for example, sodium pyrrolidone-carboxylate, sodium citrate, potassium citrate, sodium tartrate, potassium tartrate, sodium lactate, sodium succinate, potassium pantothenate, calcium lactate, sodium laurylsulfate, etc. Where an alkyl cellulose is used as the binder, it is preferably combined with a monovalent salt. Where a modified or non-modified polyvinyl alcohol is used as the binder, it is preferably combined with a monovalent salt.

In addition, where an alkyl cellulose is used as the binder, any of the following compounds may be added to the water-decomposable fibrous sheet so as to further increase the strength of the sheet. The additional compounds include, for example, copolymers of a polymerizable acid anhydride with other compounds, such as (meth) acrylic acid-maleic acid resins, (meth)acrylic acid-fumaric acid resins, etc. Preferably, the copolymers are saponified with sodium hydroxide or the like into water-soluble copolymers partially having a sodium carboxylate moiety. Adding an amino acid derivative such as trimethylglycine or the like to the sheet is also desirable, as also enhancing the strength of the sheet.

The water-decomposable fibrous sheet of the invention may optionally contain any other substances, without interfering with the advantages of the invention. For example, it may contain any of surfactants, microbicides, preservatives, deodorants, moisturizers, alcohols such as ethanol, polyalcohols such as glycerin, etc.

As having good decomposability in water and high wet strength, the water-decomposable fibrous sheet of the invention is usable as wet tissue for application to the skin of human bodies including the private parts thereof, or as cleaning sheets for toilets and thereabouts. To enhance its wiping and cleaning capabilities for those applications, the sheet may previously contain water, surfactant, alcohol, glycerin and the like. Where the water-decomposable fibrous sheet of the invention is, while being previously wetted with liquid detergent and the like, packaged for public sale, it shall be airtightly packaged and put on the market so that it is not spontaneously dried. On the other hand, the water-decomposable fibrous sheet may be marketed in dry. The users who have bought the dry water-decomposable fibrous sheet may wet it with water or liquid chemicals before use.

Since the water-decomposable fibrous sheet of the invention has high dry strength, and since it does not always require adding binders and electrolytes thereto, being different from conventional water-decomposable fibrous sheets, it is highly safe for its application to the skin. Accordingly, the fibrous sheet of the invention is usable as the sheet component of various water-decomposable absorbent articles including, for example, sanitary napkins, panty liners, sanitary tampons, disposable diapers, etc. For example, when the fibrous sheet is perforated, it may be used as the top sheet for water-decomposable absorbent articles. Even though having absorbed body discharge fluid, the fibrous sheet could still maintain a predetermined level of wet strength, and is therefore deformed little during use. When the fibrous sheet is combined with any other fibers, it is usable as an absorbent layer, a cushion layer, a back sheet, etc.

In addition, the water-decomposable fibrous sheet of the invention may have a multi-layered structure of which the top layer contains a larger amount of fibrillated rayon.

EXAMPLES

The invention is described in more detail with reference to the following Examples, which, however, are not intended to restrict the scope of the invention.

Example A

Rayon fibers (from Acordis Japan) were fibrillated in a mixer to prepare various types of fibrillated rayon having different degrees of beating as in Table 5. The fibrillated rayon was combined with ordinary non-fibrillated rayon (1.7 dtex (1.5 d), fiber length 5 mm) and bleached soft-wood kraft pulp (NBKP) (Canadian Standard Freeness, CSF=610 cc), and formed into a fibrous web. In this step, the length and the blend ratio of the fibers was varied in each Example. The fiber length of the fibrillated rayon shown in the Table 5 is that of the non-beaten rayon.

Without being dried but still on a plastic wire, the resulting fibrous web was put on a running conveyor. While being moved at the speed indicated in Table 5, the fibrous web was processed for water-jetting treatment, whereby the fibers constituting it were entangled. The high-pressure water-jetting device used for the treatment was equipped with 2000 nozzles/meter each having an orifice diameter of 95 microns, at intervals of 0.5 mm between the adjacent nozzles, and the pressure of jetting water streams applied to the web was 294 $N/cm^2$, as seen in Table 5. In that condition, jetting water was applied to the top surface of the web so that it passed through its back surface. The water-jetting treatment was repeated once again under the same condition. This is the second-stage water-jetting treatment. Next, the web was dried with a Yankee drier to obtain a water-decomposable fibrous sheet. This was then immersed in 250 g, relative to 100 g of the mass of the non-woven fabric, of ion-exchanged water. The thus-obtained water-decomposable fibrous sheet was tested in dry and in wet for decomposability in water, strength and friction fastness.

The test for decomposability in water was based on the test of JIS P-4501 indicating the degree of degradability of toilet paper. Precisely, a piece of the water-decomposable fibrous sheet having a length of 10 cm and a width of 10 cm was put into a 300-ml beaker filled with 300 ml of ion-exchanged water, and stirred therein with a rotor. The revolution speed of the rotor was 600 rpm. The condition of the test piece being dispersed in water was macroscopically observed at predetermined time intervals, and the time until the test piece was dispersed was measured (see the following Table—the data are expressed in seconds).

The wet strength was measured according to the test method stipulated in JIS P-8135. Briefly, a piece of the water-decomposable fibrous sheet having a width of 25 mm and a length of 150 mm was tested both in the machine direction (MD) and in the cross direction (CD), by the use of a Tensilon tester, for which the chuck distance was 100 mm and the stress rate was 100 mm/min. The strength at break (N) of the test piece thus measured indicates the wet strength thereof (see the following Table—the data are expressed in N/25 mm).

To determine its surface friction resistance, the fibrous sheet was tested for friction fastness according to the abrasion resistance test method for paper boards stipulated in JIS P-8136. Briefly, a rubbing member A with a piece of artificial leather attached thereto was rubbed against the fibrous sheet to be tested, under a load of 500 g (4.9 N).

The data obtained are given in Table 5.

TABLE 5

| | | | A-1 | A-2 | A-3 |
|---|---|---|---|---|---|
| NBKP (beaten) | | | 60% | 60% | 60% |
| Fibrillated rayon (1.7 dtex; degree of beating, 400 cc) | | 3 mm | 40% | | |
| | | 5 mm | | 40% | |
| | | 7 mm | | | 40% |
| WJ Pressure | | N × 2 times | 294 | 294 | 294 |
| WJ Processing Speed | | m/min | 30 | 30 | 30 |
| Weight | | $g/m^2$ | 45.1 | 42.7 | 44.4 |
| Thickness | | mm | 0.456 | 0.418 | 0.391 |
| Dry Strength | MD | N/25 mm | 10.64 | 13.17 | 14.08 |
| Dry Strength | CD | N/25 mm | 9.33 | 12.89 | 13.60 |

TABLE 5-continued

| | | | A-1 | A-2 | A-3 |
|---|---|---|---|---|---|
| Wet Strength | MD | N/25 mm | 1.39 | 3.01 | 4.30 |
| Wet Strength | CD | N/25 mm | 1.26 | 2.67 | 3.06 |
| Decomposability in water of Dry Sheet | | sec | 59 | 107 | >300 |
| Decomposability in water of Wet Sheet | | sec | 64 | 123 | >300 |
| Friction Fastness | MD | rubbing cycles | 12 | 19 | 24 |
| Friction Fastness | CD | rubbing cycles | 12 | 20 | 10 |

As in Table 5, the water-decomposable fibrous sheets of the invention are all resistant to surface friction. In addition, they have good decomposability in water, and good wet and dry strength.

Example B

Water-decomposable fibrous sheets were prepared in the same manner as in Example A. Water jets of 294 $N/cm^2$ were applied two times thereto, and the processing speed was 30 m/min. In this Example B, however, used were different types of fibrillated rayon each having different degrees of beating, as in Table 6. The fibrous sheets were tested in the same manner as above for their properties.

Fibrous sheets of Comparative Examples 1 to 3 were prepared in the same manner as above. In Comparative Example 1, however, rayon having a degree of beating of 740 cc was used; and in Comparative Examples 2 and 3, no fibrillated rayon was used. Water jets of 431 $N/cm^2$ were applied two times to the sheets, and the processing speed was 15 m/min. The fibrous sheets were tested in the same manner as above for their properties.

The data obtained are given in Table 6.

TABLE 6

| | | Co. Ex. 1 | B-1 | B-2 | B-3 | B-4 | Co. Ex. 2 | Co. Ex. 3 |
|---|---|---|---|---|---|---|---|---|
| NBKP (beaten) | | 20% | 20% | 20% | 20% | 20% | 60% | 30% |
| Fibrillated rayon (1.7 dtex x 5 mm) | beaten to 740 cc | 80% | | | | | | |
| | beaten to 600 cc | | 80% | | | | | |
| | beaten to 400 cc | | | 80% | | | | |
| | beaten to | | | | 80% | | | |

TABLE 6-continued

| | | | Co. Ex. 1 | B-1 | B-2 | B-3 | B-4 | Co. Ex. 2 | Co. Ex. 3 |
|---|---|---|---|---|---|---|---|---|---|
| | | 200 cc beaten to 100 cc | | | | | 80% | | |
| Rayon (1.7 dtex x 5 mm) | | | | | | | | 40% | 70% |
| Weight | | g/m$^2$ | 42.8 | 42.5 | 44.4 | 42.0 | 40.5 | 43.4 | 46.5 |
| Thickness | | mm | 0.477 | 0.372 | 0.387 | 0.322 | 0.287 | 0.556 | 0.661 |
| Dry Strength | MD | N/25 mm | 3.70 | 8.65 | 14.64 | 15.93 | 15.80 | 9.38 | 5.05 |
| Dry Strength | CD | N/25 mm | 3.63 | 10.40 | 14.71 | 18.47 | 15.72 | 6.59 | 4.37 |
| Wet Strength | MD | N/25 mm | 1.54 | 1.73 | 4.98 | 5.30 | 6.00 | 1.36 | 1.51 |
| Wet Strength | CD | N/25 mm | 0.65 | 2.11 | 4.99 | 4.82 | 4.78 | 0.99 | 1.30 |
| Absolute Wet Strength | | N/25 mm | 1.00 | 1.91 | 4.98 | 5.05 | 5.35 | 1.16 | 1.40 |
| Decomposability in water of Dry Sheet | | sec | >300 | >300 | >300 | 104 | 107 | 122 | 144 |
| Decomposability in water of Wet Sheet | | sec | >300 | >300 | >300 | 175 | 141 | 128 | 204 |

As in Table 6, the water-decomposable fibrous sheets of the invention are highly resistant to surface friction. On the other hand, the fibrous sheets of Comparative Examples 1, 2 and 3 are resistant to friction in some degree, but their decomposability in water and/or wet strength are poor. It is understood that the decomposability in water of the comparative fibrous sheets does not balance with the mechanical strength thereof.

Example C

Water-decomposable fibrous sheets were prepared in the same manner as in Example A. In Example C, however, the fibers were sheeted according to a vat paper-making process, and the fibrous sheets were not processed for water-jetting treatment. The fibrous sheets were tested in the same manner as above for their properties. As they were produced according to a vat paper-making process, there is no significant difference between the strength in MD and that in CD.

The data obtained are given in Table 7.

TABLE 7

| Sample No. | | C-1 | C-2 | C-3 |
|---|---|---|---|---|
| NBKP (beaten) | | 20% | 20% | 20% |
| Fibrillated Rayon (1.7 dtex × 5 mm) | beaten to 600 cc | 80% | | |
| | beaten to 400 cc | | 80% | |
| | beaten to 200 cc | | | 80% |
| Weight | g/m$^2$ | 46.5 | 44.6 | 41.7 |
| Thickness | mm | 0.289 | 0.266 | 0.194 |
| Dry strength | N/25 mm | 6.87 | 10.30 | 16.08 |
| Wet strength | N/25 mm | 0.97 | 1.32 | 2.48 |
| Decomposability in water of Dry sheet | sec | >300 | 52 | 30 |
| Decomposability in water of Wet Sheet | sec | >300 | 43 | 21 |
| Friction Fastness | number of rubbing cycles | 5 | 3 | 5 |

Example D

Water-decomposable fibrous sheets were prepared in the same manner as in Example A. These were all processed for water-jetting treatment. The fibrous sheets were tested in the same manner as above for their properties. In Example D, however, the degree of beating (Canadian Standard Freeness, CSF) of the bleached soft-wood kraft pulp (NBKP) was 600 cc; the pressure of the water jets was 294 N/cm$^2$; and the processing speed was 30 m/min. Like in Example A, the sheets were exposed to water jets two times.

The data obtained are given in Table 8.

TABLE 8

| | Comp. Example single-layered | D-1 single-layered | D-2 single-layered | D-3 single-layered | D-4 single-layered |
|---|---|---|---|---|---|
| NBKP (600 cc) | 60% | 60% | 60% | 60% | 60% |
| Fibrillated Rayon (1.7 dtex × 5 mm) | — | 5% | 10% | 20% | 40% |
| Rayon (1.7 dtex × 5 mm) | 40% | 35% | 30% | 20% | — |
| Dry Strength (N/25 mm) | 18.6 | 21.8 | 24.7 | 21.5 | 24.3 |
| Wet Strength (N/25 mm) | 2.7 | 2.9 | 3.3 | 4.0 | 4.2 |
| Dry Friction Fastness (number of rubbing cycles) | 5 | 7 | 10 | 17 | 24 |
| Wet Friction Fastness (number of rubbing cycles) | 1 | 3 | 5 | 8 | 12 |
| Water Decomposability in water of Dry Sheet (sec) | 139 | 126 | 108 | 123 | 135 |
| Water Decomposability in water of Wet Sheet (sec) | 130 | 128 | 127 | 144 | 137 |

Example E

Water-decomposable fibrous sheets were prepared in the same manner as in Example D. In this, however, each fibrous sheet had a two-layered structure composed of a fibrillated rayon-containing top layer and a back layer not containing fibrillated rayon. All the fibrous sheets were processed for water-jetting treatment.

The data obtained are given in Table 9.

TABLE 9

| | E-1 | | E-2 | |
|---|---|---|---|---|
| | top layer | back layer | top layer | back layer |
| NBKP (600 cc) | 60% | 60% | 60% | 60% |
| Fibrillated Rayon (1.7 dtex × 5 mm) | 10% | — | 20% | — |
| Rayon (1.7 dtex × 5 mm) | 30% | 40% | 20% | 40% |
| Overall Fibrillated Rayon Content of Fibrous Sheet | 5% | | 10% | |
| Dry Strength (N/25 mm) | 17.8 | | 22.2 | |
| Wet Strength (N/25 mm) | 3.1 | | 3.1 | |
| Dry Friction Fastness (number of rubbing cycles) | 12 | | 15 | |
| Wet Friction Fastness (number of rubbing cycles) | 7 | | 9 | |
| Water Decomposability in water of Dry Sheet (sec) | 105 | | 97 | |
| Water Decomposability in water of Wet Sheet (sec) | 114 | | 124 | |

Example F

In Example F, the samples D-1 and E-1 prepared in Example D and Example E were processed for skin formation. The thus-processed fibrous sheets were tested for their properties. For skin formation treatment, each fibrous sheet sample was pressed between a rotary drier and a roll at 130° C. and under a pressure of 0.02 N.

The data obtained are given in Table 10.

TABLE 10

| | F-1 | F-2 | |
|---|---|---|---|
| | single-layered | top layer | back layer |
| NBKP (600 cc) | 60% | 60% | 60% |
| Fibrillated Rayon (1.7 dtex × 5 mm) | 5% | 10% | — |
| Rayon (1.7 dtex × 5 mm) | 35% | 30% | 40% |
| Overall Fibrillated Rayon Content of Fibrous Sheet | 5% | 5% | |
| Dry strength (N/25 mm) | 26.2 | 21.1 | |
| Wet Strength (N/25 mm) | 3.5 | 3.8 | |
| Dry Friction Fastness (number of rubbing cycles) | 15 | 18 | |
| Wet Friction Fastness (number of rubbing cycles) | 6 | 12 | |
| Water Decomposability in water of Dry Sheet (sec) | 132 | 118 | |

TABLE 10-continued

| | F-1 | F-2 | |
|---|---|---|---|
| | single-layered | top layer | back layer |
| Water Decomposability in water of Wet Sheet (sec) | 141 | 134 | |

Comparing D-1 in Table 8 with F-1 in Table 10, and E-1 in Table 9 with F-2 in Table 10, it is understood that the skin formation treatment enhances the surface strength (friction fastness) of the processed fibrous sheets and lowers little the decomposability in water thereof. In addition, the dry and wet strength of the processed fibrous sheets was increased.

As is understood from the test data as above, the water-decomposable fibrous sheet of the invention has good decomposability in water and high strength and is resistant to surface friction, taking advantage of the tangling and/or hydrogen-bonding force of the microfibers that extend from the fibrillated rayon therein. In particular, in the fibrous sheet processed for skin formation, the hydrogen-bonding force of the microfibers is increased, and the surface friction resistance of the processed fibrous sheet is therefore increased. The skin formation treatment does not interfere with the decomposability in water of the processed fibrous sheet.

Accordingly, when the fibrous sheet is used for wiping objects, the microfibers of the fibrillated rayon in its surface are directly contacted with the objects, and the friction to the fibrous sheet is reduced, and therefore the fibrous sheet enjoys good durability for wiping applications. In addition, when the fibrous sheet is used for the top sheet of absorbent articles, it is not deformed during use and gives a comfortable feel to users.

Here, 'comprises/comprising' when used in this specification is taken to specify the presence of stated features, integers, steps or components but does not preclude the presence or addition of one or more other features, integers, steps, components or groups thereof.

While the invention has been described in detail and with reference to specific embodiments thereof, it will be apparent to one skilled in the art that various changes and modifications can be made therein without departing from the spirit and scope thereof.

What is claimed is:

1. A hydroentangled water-decomposable fibrous sheet comprising from 3 to 20% by mass of fibrillated rayon comprising larger non-micro fibers and smaller microfibers extending from the larger non-micro fibers, and a balance being non-fibrillated rayon and pulp having a length of at most 10 mm, wherein larger non-micro fibers have a length in a range of from 2.5 to 6.5 mm at a peak of mass distribution thereof, smaller microfibers having a length of at most 1 mm account for from 0.1 to 50% by mass of a self-weight of the fibrillated rayon, and wherein a surface friction resistance of the fibrous sheet when dry, measured according to an abrasion resistance test method of JIS P-8136, is at least three rubbing cycles.

2. The hydroentangled water-decomposable fibrous sheet as claimed in claim 1, of which the surface friction resistance of the fibrous sheet when wet is at least three rubbing cycles.

3. The hydroentangled water-decomposable fibrous sheet as claimed in claim 1, of which the surface is pressed under heat so that the smaller microfibers of the fibrillated rayon in the surface are hydrogen-bonded to at least either of other microfibers and other fibers therein.

4. The hydroentangled water-decomposable fibrous sheet as claimed in claim 1, wherein the fibrous sheet has a multi-layered structure including a layer not containing the fibrillated rayon.

5. The hydroentangled water-decomposable fibrous sheet as claimed in claim 1, wherein the degree of fineness of the fibrillated rayon is in a range between 1.1 and 1.9 dtex.

6. The hydroentangled water-decomposable fibrous sheet as claimed in claim 1, wherein the weight of the fibers is in range between 20 and 100 $g/m^2$.

7. The hydroentangled water-decomposable fibrous sheet as claimed in claim 1, of which the decomposability in water, measured according to JIS P-4501, is at most 200 seconds.

8. The hydroentangled water-decomposable fibrous sheet as claimed in claim 1, of which the wet strength is at least 1.1 N/25 mm.

9. The hydroentangled water-decomposable fibrous sheet as claimed in claim 1, of which the dry strength is at least 3.4 N/25 mm.

* * * * *